US005441853A

United States Patent [19]

Fyson et al.

[11] Patent Number: 5,441,853

[45] Date of Patent: Aug. 15, 1995

[54] METHOD OF MAKING STABLE COLOR PHOTOGRAPHIC PRINTS

[75] Inventors: John R. Fyson, London, England; Roland G. Willis, Rochester, N.Y.

[73] Assignee: Eastman Kodak Company, Rochester, N.Y.

[21] Appl. No.: 98,301

[22] PCT Filed: Dec. 10, 1992

[86] PCT No.: PCT/EP92/02850

§ 371 Date: Nov. 26, 1993

§ 102(e) Date: Nov. 26, 1993

[87] PCT Pub. No.: WO93/12464

PCT Pub. Date: Jun. 24, 1993

[30] Foreign Application Priority Data

Dec. 12, 1991 [GB] United Kingdom ..... 9126386

[51] Int. Cl.[6] ..... G03C 11/00

[52] U.S. Cl. ..... 430/373; 430/394; 430/414; 430/417

[58] Field of Search ..... 430/373, 414, 943, 394, 430/417

[56] References Cited

U.S. PATENT DOCUMENTS 5,210,007 5/1993 Texter et al. ..... 430/943

FOREIGN PATENT DOCUMENTS

3228192A1 2/1983 Germany .
1268126 3/1972 United Kingdom .
1399481 7/1975 United Kingdom .
1403418 8/1975 United Kingdom .
1560572 2/1980 United Kingdom .
WO91/12567 8/1991 WIPO .

*Primary Examiner*—Hoa Van Le
*Attorney, Agent, or Firm*—J. Lanny Tucker

[57] ABSTRACT

A method of making a photographic color print using a photographic color material containing low levels of silver halide characterized in that, (a) after image formation and washing and/or stop bath treatment and (b) before non-uniform exposure to adventitious light, the print is uniformly exposed to a light source so that undeveloped silver halide is caused to print out uniformly. Such a uniform density is much more acceptable than a non-uniform density caused by uneven light in normal conditions.

11 Claims, No Drawings

METHOD OF MAKING STABLE COLOR PHOTOGRAPHIC PRINTS

This invention relates to a method of making stable photographic colour prints and particularly to making such prints with photographic materials that contain low levels of silver halide.

There have been many proposals to reduce the amount of silver halide employed in photographic colour materials and colour print materials in particular. One preferred method is to use the so-called redox amplification processes.

Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or a combined developer-amplifier) to form a dye image. The developer-amplifier solution contains a reducing agent, for example a colour developing agent, and an oxidising agent which will oxidise the colour developing agent in the presence of the silver image which acts as a catalyst. The photographic material used in such a process may be a conventional coupler-containing silver halide material or an image transfer material containing redox dye releasers. Oxidised colour developer reacts with a colour coupler (usually contained in the photographic material photographic material) to form image dye. The amount of dye formed depends on the time of treatment or the availability of colour coupler rather than the amount of silver in the image as is the case in conventional colour development processes. Examples of suitable oxidising agents include peroxy compounds including hydrogen peroxide and compounds which provide hydrogen peroxide, eg addition compounds of hydrogen peroxide; cobalt (III) complexes including cobalt hexammine complexes; and periodates. Mixtures of such compounds can also be used. A particular application of this technology is in the processing of silver chloride colour paper, especially such paper with low silver levels.

Photographic paper for redox amplification processes can be made with increasingly low levels of silver halide. When the level is small enough the density of the developed silver is barely noticeable in the finished print. However over a period of time the undeveloped silver halide remaining in the paper tends to print out (ie the silver halide is reduced to visible silver image) non-uniformly due to the non-uniform nature of exposure by adventitious light. This non-uniform printout does tend to be noticeable when viewing the print.

According to the present invention there is provided a method of making a photographic colour print using a photographic colour material containing low levels of silver halide characterised in that, (a) after image formation and washing and/or stop bath treatment and (b) before non-uniform exposure to adventitious light, the print is uniformly exposed to a light source so that undeveloped silver halide is caused to print out uniformly.

The exposure can be at any stage after which further imagewise image formation can occur. This will be, for example, when any developer has been removed by washing or inactived by a stop bath.

The uniform silver image, in contrast to the non-uniform image normally produced by print-out over a period of time, is not noticeable when viewing the print. The non-uniform exposure to light occurs because of the varied light conditions, degree of shading falling on different parts of the picture at different times in its history, etc. Under normal processing lab arrangements the prints are placed in packaging for return to the customer very soon after coming off the "production line" under ordinary room light conditions.

In a preferred embodiment the uniform exposure occurs before the print is delivered to the customer. It is convenient if the uniform exposure means is built into the processing machine used to make the print.

The uniform exposure is preferably accomplished in the processing apparatus using appropriately mounted exposure means such as tungsten bulbs or fluorescent tubes. Clearly no exposure of the photographic material should occur before the development and/or amplification has fully taken place. Such apparatus is known from the processing of reversal films including reversal colour films of the "Kodachrome" type wherein separate light fogging of the red and blue-sensitive layer units is employed. Alternatively the finished print could merely be place under a uniform light source for a while before being packaged and returned to the customer.

Preferably, the light source for the uniform exposure is an incandescent, fluorescent, arc or mercury lamp, electronic flash or the sun. The time of exposure to the uniform light should be sufficient that all undeveloped silver halide is reduced to silver. Typically such a time is from 0.1 to 500 seconds, preferably from 1 to 100 seconds, more preferably from 2 to 30 seconds. The optimum exposure time can be determined by experiment.

The advantages of the present process are that only the image-forming step is needed while the traditionally needed bleach and/or fix steps can be omitted; fewer processing tanks need be used; the provision of the exposing radiation is inexpensive and non-polluting; and the omission of the bleach and/or fix reduces the effluent from the process.

Preferably the image-forming process is a colour redox amplification process employed hydrogen peroxide or a compound which provides hydrogen peroxide. The colour photographic material to be processed may be of any type but will preferably contain low amounts of silver halide. Preferred silver halide coverages are in the range 0.1 to 80, preferably 0.1 to 20, particularly 0.1 to 3 $mg/m^2$ (as silver). The material may comprise the emulsions, sensitisers, couplers, supports, layers, additives, etc. described in Research Disclosure, December 1978, Item 17643, published by Kenneth Mason Publications Ltd, Dudley Annex, 12a North Street, Emsworth, Hants P010 7DQ, U.K.

In a preferred embodiment the photographic material comprises a resin-coated paper support and the emulsion layers comprise more than 80%, preferably more than 90% silver chloride and are more preferably composed of substantially pure silver chloride. Preferably the amplification solution contains hydrogen peroxide and a colour developing agent.

The photographic materials can be single colour materials or multicolour materials. Multicolour materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolour photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

Preferably the processing essentially comprises a single developer/amplifier step or a developer step followed by amplifier or developer/amplifier step. Optionally wash, stop and/or dry steps may be added.

The following Examples are included for a better understanding of the invention.

EXAMPLE 1

A developer amplifier was made up of the following formulation:

| | |
|---|---|
| Potassium carbonate | 25 g |
| 1-hydroxyethylidene-1,1'-diphosphonic acid | 0.6 g |
| diethyltriamine-pentaacetic acid | 0.6 g |
| Diethylhydroxylamine | 5.0 g |
| Potassium chloride | 1.35 g |
| 4-N-ethyl-N-(b-methane-sulphonamidoethyl)-o-toluidine sesquisulphate | 3.5 g |
| Hydrogen peroxide 30% | 10.0 g |
| Water to | 1 liter |
| pH adjusted to 10.3 with sodium hydroxide solution | |

A colour photographic silver chloride paper having a total silver chloride laydown of 55 mg/m2 (as silver) was used. A piece of this paper was processed for 30 seconds at 40° C., in the above developer amplifier, without being exposed to light. The paper was then plunged into a 5% acetic acid stop bath solution to prevent further development. The paper was then split into two pieces. One piece was exposed to direct sunlight for 5 minutes. When viewed without reference to other strips the stain of this print appeared acceptable. The other piece was left in subdued room light. The strips were then hung up to dry in subdued light.

The processed strips were put in a high intensity fading device, which essentially meant placing the strips two inches away from lit daylight fluorescent bulb, with half the area of each strip covered with a piece of black paper. The strips were held in position for two hours and then the neutral reflection density was measured. The results for the changes in density are shown below. They clearly show that the strip that had been exposed to sunlight before completion of drying, experienced no further printout. The unexposed strip reached the same density of the pre-exposed strip only in the areas exposed to light. This left an undesirable density step at the edge of the shadowed area.

| Treatment | Initial neutral density after processing | 2 hr post exposure neutral density |
|---|---|---|
| NONE | 0.14 | 0.17 |
| sunlight exposed | 0.17 | 0.17 |

We claim:

1. A method of making a photographic colour print using a photographic colour material containing low levels of silver halide, comprising:

forming an image on the photographic colour material;

washing the photographic colour material and/or treating the photographic colour material in a stop bath after said forming of said image;

uniformly exposing the photographic colour material to a light source after said washing and/or said treating, whereby undeveloped silver halide in said photographic colour material prints out uniformly; and non-uniformly exposing the photographic colour material to adventitious light.

2. A method according to claim 1, wherein said uniformly exposing is carried out before said photographic colour material is delivered to a customer.

3. A method according to claim 1, wherein said light source is an incandescent lamp, a fluorescent lamp, an arc lamp, a mercury lamp, an electronic flash, or the sun.

4. A method according to claim 1, wherein said uniformly exposing is carried out for a period of from 0.1 to 500 seconds.

5. A method according to claim 1, wherein said forming of said image comprises a redox amplification process.

6. A method according to claim 1, wherein the photographic colour material subjected to said uniformly exposing is an unbleached, unfixed photographic colour material.

7. A method according to claim 1, wherein said photographic colour material comprises silver halide at a total coating weight of from 0.1 to 80 mg/m$^2$ as silver.

8. A method according to claim 7, wherein said photographic colour material comprises silver halide at a total coating weight of from 0.1 to 20 mg/m$^2$ as silver.

9. A method according to claim 7, wherein said photographic colour material comprises silver halide at a total coating weight of from 0.1 to 3 mg/m$^2$ as silver.

10. A method according to claim 1, wherein said photographic colour material comprises silver halide containing at least 80% silver chloride.

11. A method according to claim 1, wherein said photographic colour material comprises silver halide containing at least 90% silver chloride.

* * * * *